United States Patent [19]

Andruchiw

[11] Patent Number: 4,527,660

[45] Date of Patent: Jul. 9, 1985

[54] POLE CLIMBING AID

[76] Inventor: Roman Andruchiw, 137 Spring Garden Ave., Willowdale, Ontario, Canada, M2N 3G6

[21] Appl. No.: 568,068

[22] Filed: Jan. 4, 1984

[30] Foreign Application Priority Data

Jan. 17, 1983 [CA] Canada ..... 491564

[51] Int. Cl.[3] ..... A62B 35/00

[52] U.S. Cl. ..... 182/9; 182/136

[58] Field of Search ..... 182/3, 4–9, 182/133, 135, 136

[56] References Cited

U.S. PATENT DOCUMENTS

| | | | |
|---|---|---|---|
| 869,382 | 10/1907 | Newton | 182/9 |
| 2,392,538 | 1/1946 | Knudsen | 182/136 |
| 2,842,300 | 7/1958 | Johnson | 182/133 |
| 3,840,091 | 10/1974 | Conlon | 182/9 |
| 3,968,858 | 7/1976 | Vollan | 182/136 |
| 4,168,765 | 9/1979 | Ferguson | 182/187 |
| 4,407,391 | 10/1983 | Greenway | 182/9 |

FOREIGN PATENT DOCUMENTS

| | | | |
|---|---|---|---|
| 512547 | 2/1955 | Italy | 182/133 |

*Primary Examiner*—Reinaldo P. Machado
*Attorney, Agent, or Firm*—Ridout & Maybee

[57] ABSTRACT

A pole climbing aid is disclosed which comprises a hand grip member adapted to be attached to a pole to be climbed and to be grasped by a climber to assist him in climbing the pole. The hand grip member can easily be repositioned on the pole at a desired location thereon, and can be attached by means of a safety line to a body belt worn about the climber's waist to secure the climber to the pole.

23 Claims, 13 Drawing Figures

POLE CLIMBING AID

This invention relates to climbing aids for use in climbing hydro-electric, telephone and other utility poles.

When climbing utility poles it is common to employ a safety belt which comprises a body belt portion worn about the climber's waist, and a safety belt portion which extends about the utility pole. Such a safety belt is generally used in combination with spurs attached to the climbers boots, the spurs providing the primary means of supporting the weight of the climber.

It is known to provide means for tightening the safety belt portion about the utility pole to prevent a fall in the event that the spurs fail to grip the pole.

The present invention provides an improved climbing aid which may be used in combination with spurs and a safety belt of conventional design to provide greater security for a climber.

According to one aspect of the present invention a hand held pole climbing aid comprises a hand grip member having a blade portion at one end disposed to extend transversely across a pole to be climbed, a handle portion at the other end adapted to be grasped to pivot the hand grip member downwardly about said blade portion, a pair of toothed portions extending downwardly at the ends of said blade portions and adapted to engage the pole upon pivotal movement of the hand grip member, a safety line of relatively stiff but flexible material adapted to form a bight to extend loosely about the pole for holding said hand grip member to the pole, means for removably attaching first and second end portions of said line to the hand grip member to permit the line to form a bight extending therefrom at a predetermined angle which is inclined in an upward direction, said attaching means including adjustable gripping means engageable with the second end portion of the safety line to permit movement of said second end portion with respect to the hand grip member for adjusting the size of the bight, said adjustable gripping means being responsive to tension in the safety line for restraining said second end portion.

According to another aspect of the present invention a climbing aid comprising in combination, a flexible safety belt adapted to be extended about a pole to be climbed, comprising a pair of belt segments one end of each being attachable to a respective side of a body belt portion worn about the waist, while the other ends are provided with means for detachably interconnecting them about the pole; a retractable safety belt member adapted to extend about the pole, means provided on one belt segment selectively operable for extending and retracting the retractable safety belt member, and means for detachably securing the retractable safety belt member to the other belt segment.

According to yet another aspect of the present invention a hand held pole climbing aid comprising a hand grip member having a blade portion at one end disposed to extend transversely across a pole to be climbed, a handle portion at the other end adapted to be grasped to pivot the hand grip member downwardly about said blade portion, a pair of toothed portions extending downwardly at the ends of said blade portion and adapted to engage the pole upon pivotal movement of the hand grip member, a safety line of relatively stiff but bendable material adapted to form a bight extending loosely about the pole for holding said hand grip member to the pole, means for removably attaching first and second end portions of said safety line to the hand grip member to permit the line to form a bight to extend therefrom at a predetermined angle which is inclined in an upward direction, said attaching means including adjustable gripping means engageable with the second end portion of the safety line to permit movement of said second end portion with respect to the hand grip member for adjusting the size of the bight, said adjustable gripping means being responsive to tension in the line for restraining said second end portion; and a second flexible safety line adapted to form a bight extending in front of the climber's waist and providing end portions having respectively, first and second attachment means for attachment to a safety belt worn about the climber's waist, said second end portion of the first-mentioned safety line having a snap-hook adapted to be hooked onto said bight.

Several embodiments of the invention will now be described by way of example, with reference to the accompanying drawings, in which.

Figure 9:
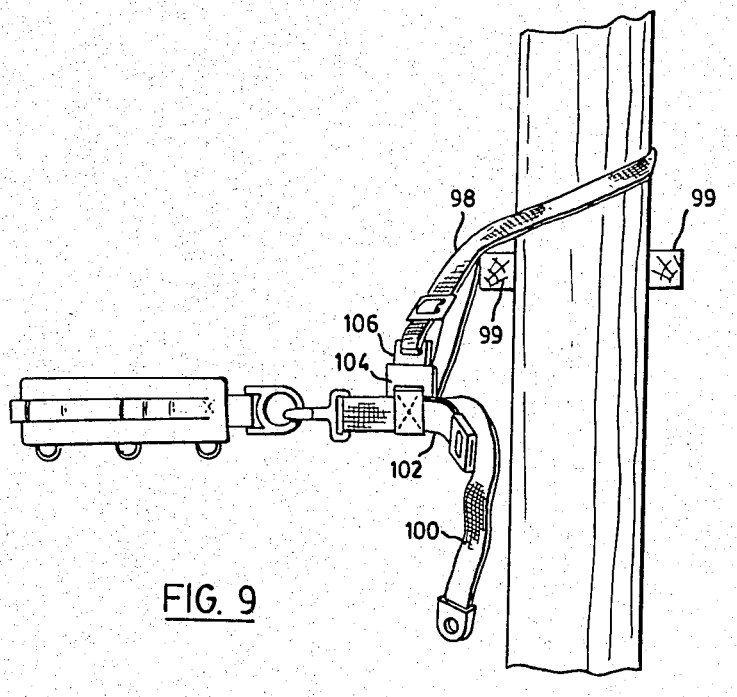
Figure 6:
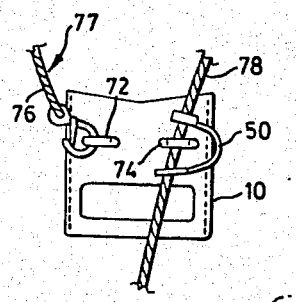
Figure 5:
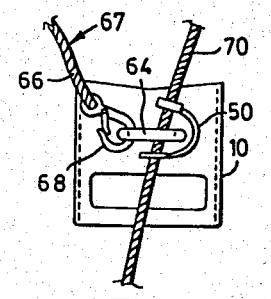
Figure 10:
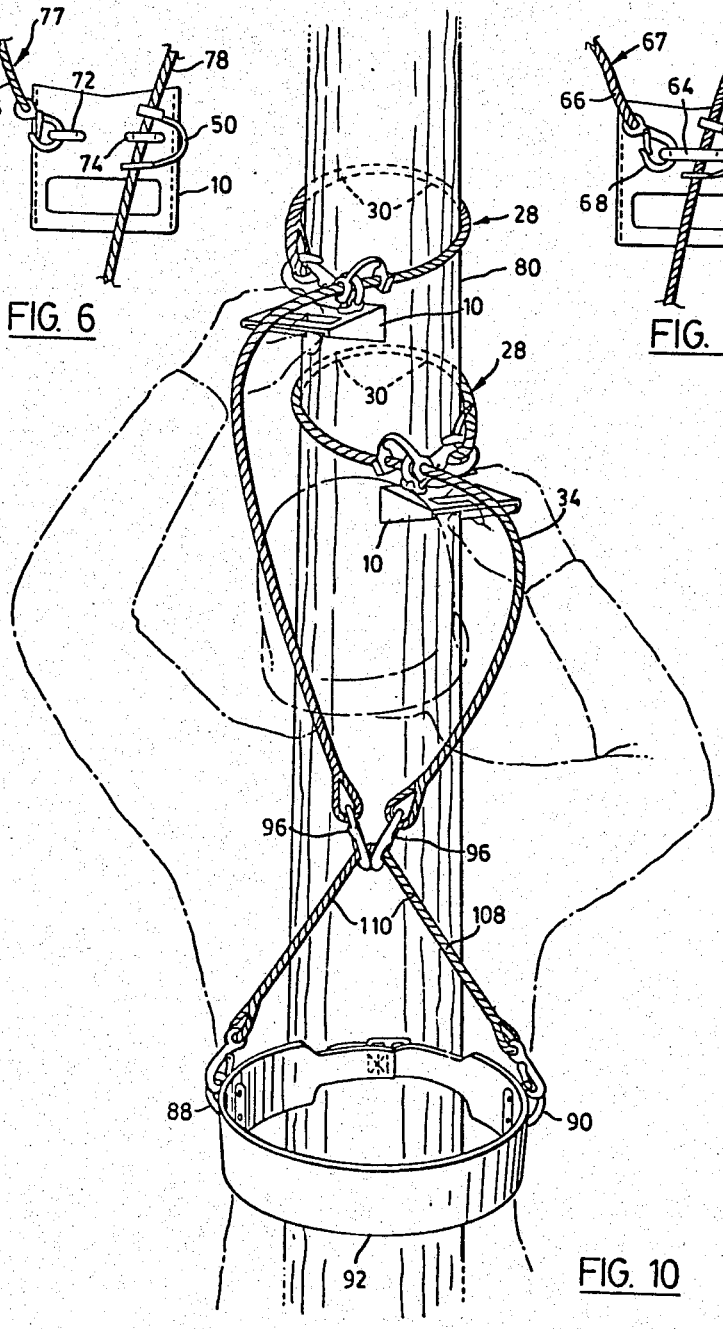
Figure 7:
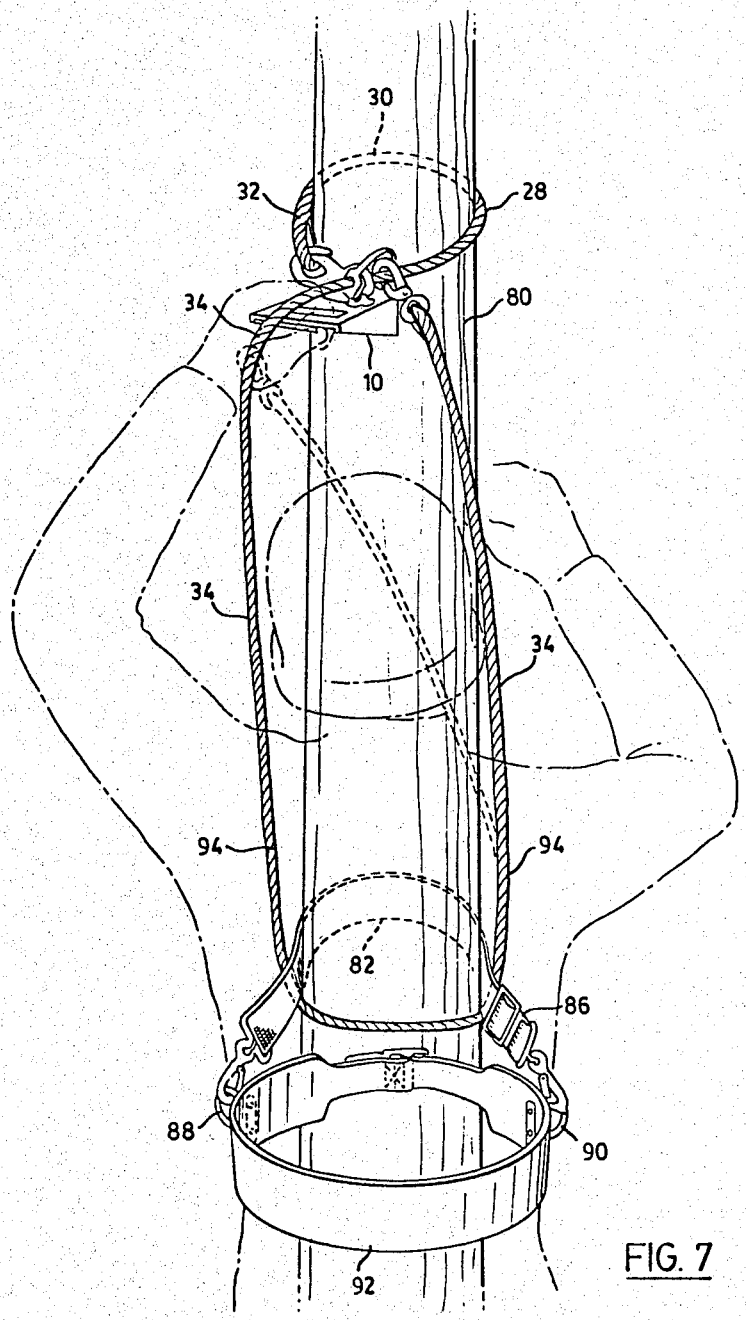
Figure 8:
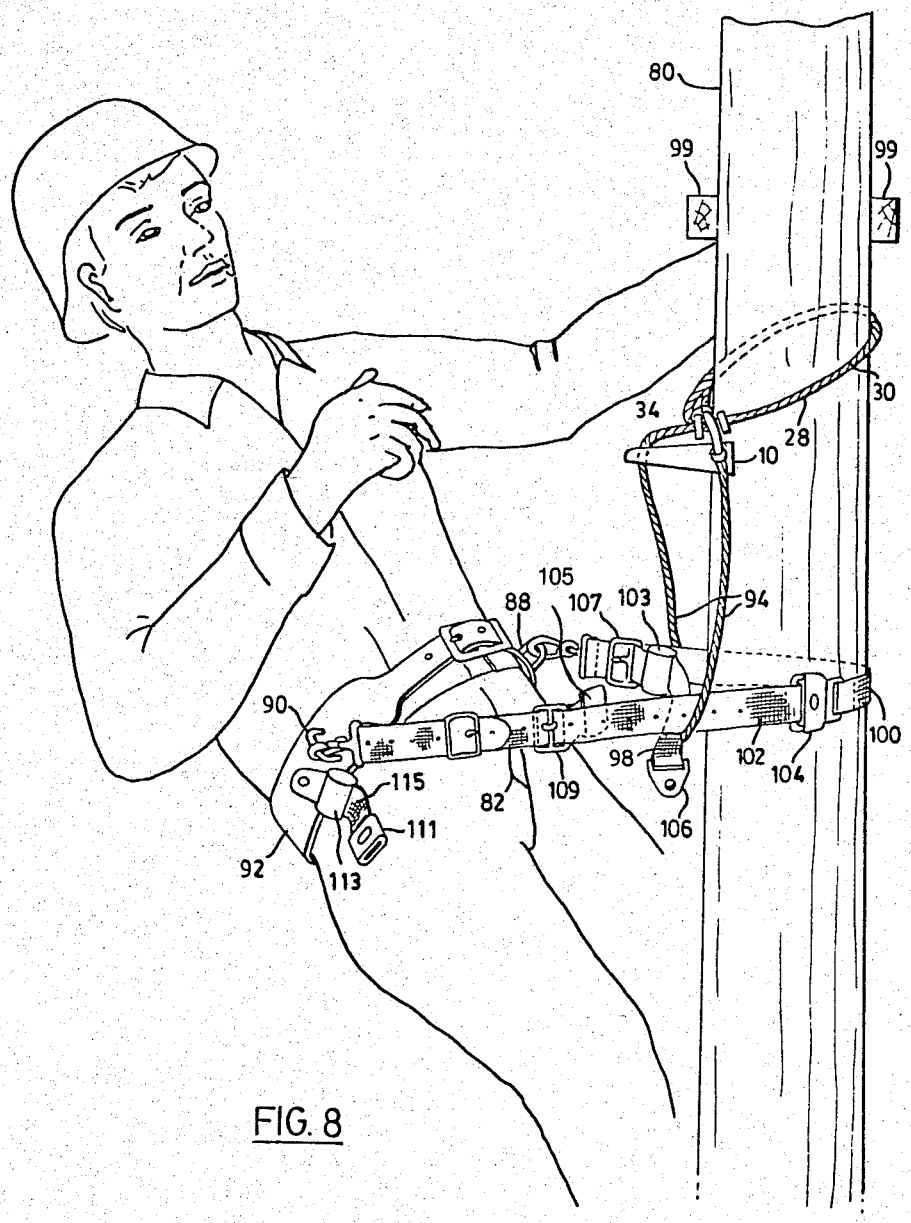
Figure 11:
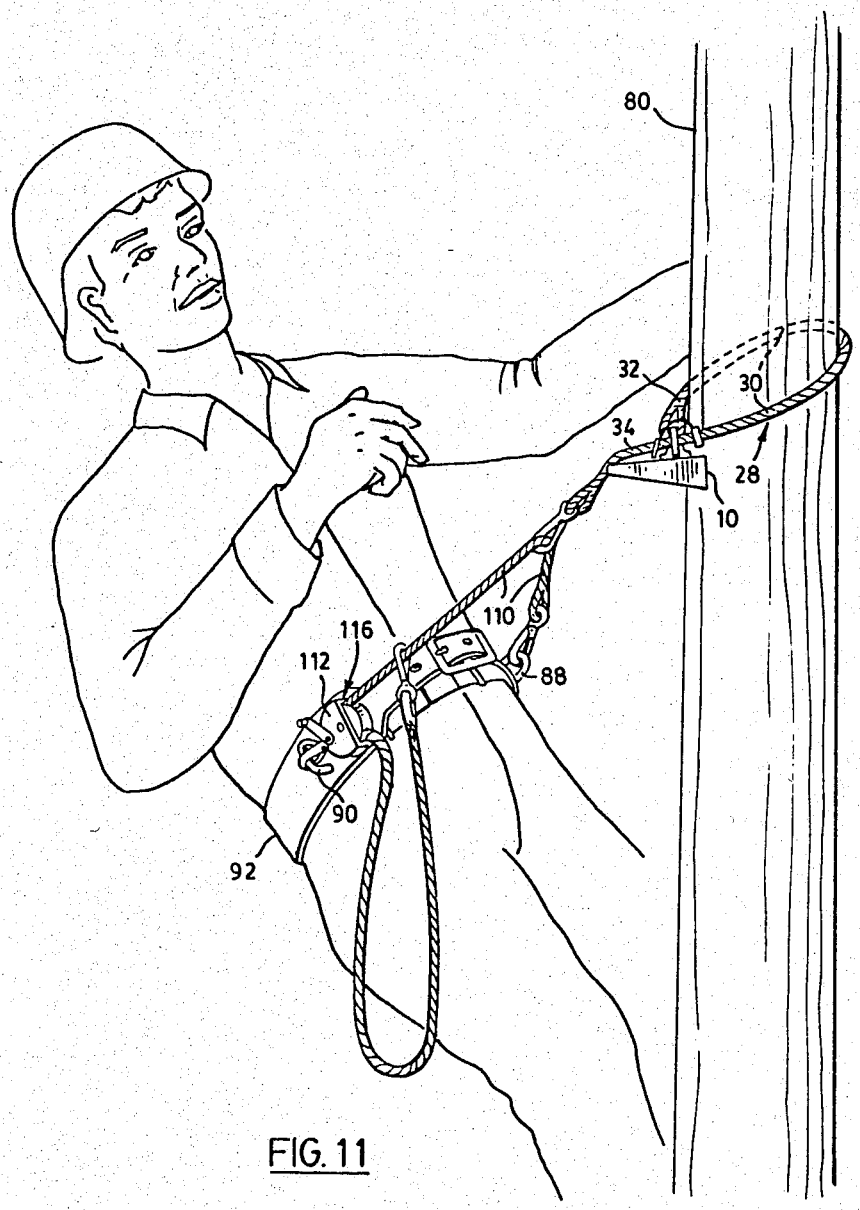
Figure 12:
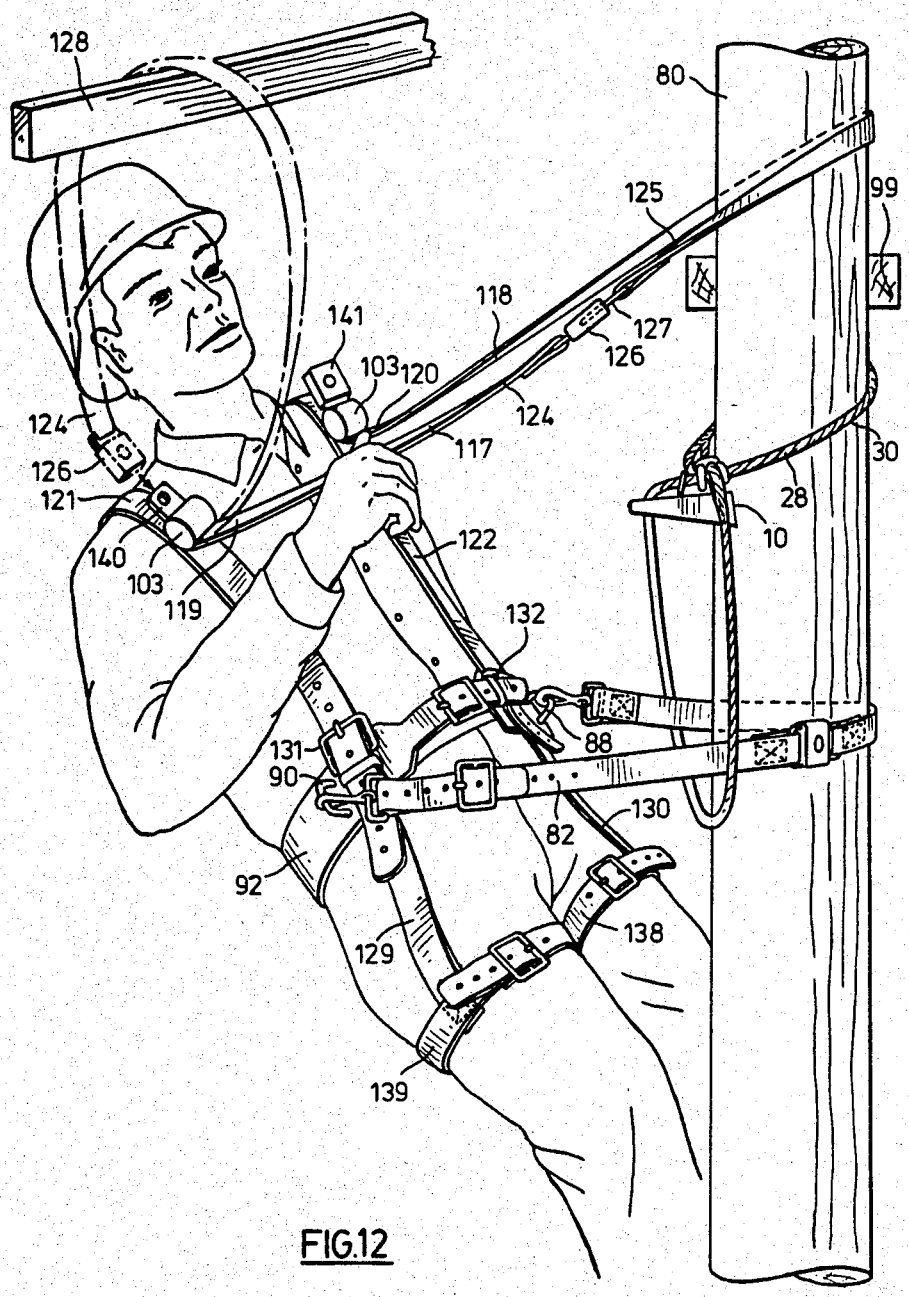
Figure 13:
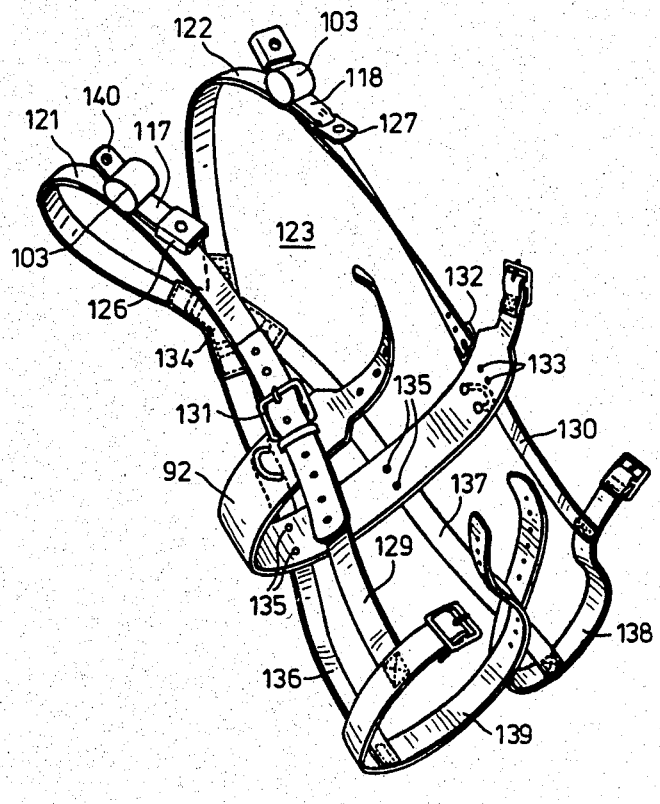

FIGS. 5 and 6, respectively, are plan views of two further hand grip members which may be used in the present invention;

FIG. 7 illustrates a pole climbing aid according to the invention, in use;

FIG. 8 illustrates a second pole climbing aid according to the invention in use;

FIG. 9 (on the second page of drawings) is a side view of a third climbing aid according to the invention;

FIG. 10 (on the third page of drawings) illustrates yet another pole climbing aid according to the invention;

FIG. 11 illustrates yet another pole climbing aid according to the invention;

FIG. 12 illustrates a further pole climbing aid according to the invention in use; and FIG. 13 is a perspective view of a safety harness, being a portion of the climbing aid of FIG. 12.

Referring to the drawings, an important element of each pole climbing aid described herein is a hand grip member 10, as shown for example, in FIGS. 1 to 6. In each of these figures corresponding parts are designated by like numerals wherever appropriate.

Figure 1:
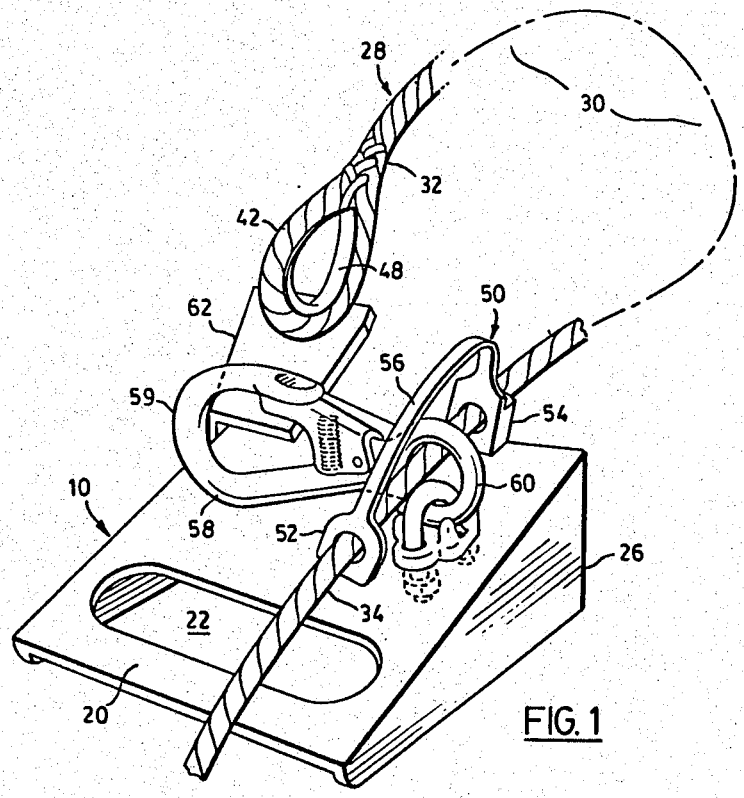
FIG. 1 is a perspective view from the rear, of a first hand grip member used in a climbing aid according to the invention.
Figure 2:
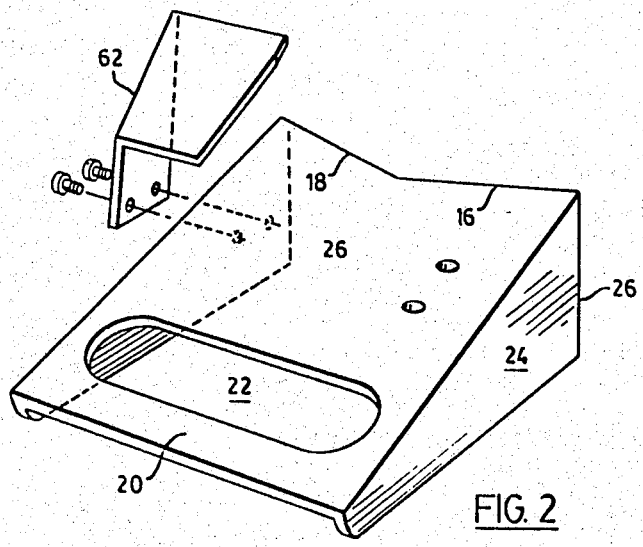
FIG. 2 is an exploded perspective view of part of the hand grip member of FIG. 1.

FIGS. 1 and 2 illustrate such a hand grip member 10 for use by a climber as an aid in climbing a utility pole. The hand grip member 10 comprises a flat, rigid elongated body portion 12, of sheet aluminum or other durable material, its front end being formed as a blade portion 14 which is adapted to be placed transversely across a pole to be climbed. The blade portion 14 is preferably formed with an inwardly contoured edge to approximate the curvature of the pole to be climbed and configured to provide a plurality of spaced contact edges to engage the pole for locating the hand grip member with respect to the pole. In the present example, the blade has a shallow, V-shaped contour, providing two spaced contact edges 16, 18.

A handle portion 20 is formed at the end of the body portion 12 remote from the blade portion 14. The handle portion 20 is integrally formed with the body portion a transverse finger hole 22 being machined near the remote end of the body 12. The handle portion 20 is adapted to be grasped by the climber so as to pivot the hand grip member downwardly about the end forming the blade portion 14.

Downturned side portions 24 extend along the full length of the body and form integrally with the body a pair of toothed portions 26 at opposite ends of the blade portion 14, which are adapted to bite into the pole upon downward pivotal movement of the hand grip member about the said remote end.

An elongated safety line 28 of relatively stiff but flexible material is attached to the hand grip member 10 so as to form a bight 30 to extend loosely about the pole, for adjustably securing the hand grip member to the pole. It is important that the line 28 be flexible to permit it to be adjusted about the pole, and to retain sufficient rigidity and torsional strength to permit the bight 30 formed thereby to retain its shape when formed and to be relatively self-supporting to avoid binding against the pole while moving therealong. The line may suitably comprise an inner portion of braided fibrous material, such as a nylon rope, and an outer coating of a suitable material such as nylon, formed about the inner portion for added rigidity and torsional strength.

Figure 3:
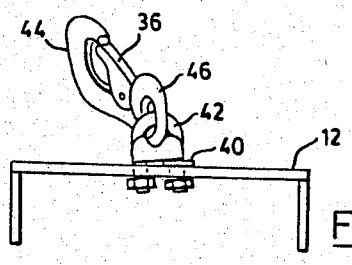
FIG. 3 is a rear end view of a second hand grip member.
Figure 4:
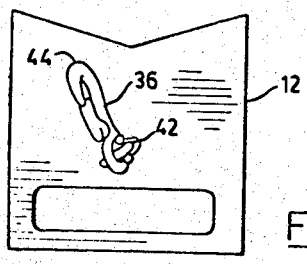
FIG. 4 is a plan view of the hand grip member of FIG. 3.

Means are provided for removably attaching the opposite end portions 32 and 34 of the safety line 28 to the hand grip member 10 in a manner to permit the line to be formed into the bight 30 extending forwardly from the hand grip member and at an upwardly inclined angle. Various means of attachment may be employed, and several of these are illustrated in FIGS. 1 to 6. One preferred means of attachment is shown in FIGS. 3 and 4. In this a safety snap-hook 36 which is secured by a clamp 42 to the upper surface of the body portion 12 extends forwardly and upwardly relative to the body portion 12. The attitude of the snap-hook 36 is preferably inclined slightly from the vertical direction by a washer 40 positioned under one leg of the clamp 42 which secures the snap-hook to the body member 12. The snap-hook has a hook portion 44 for attaching a looped first end portion 32 of the safety line 28, and a ring portion 46 by which the snap-hook is secured to the body portion 12 by means of the clamp 42. A loop 32A on the first end portion 32 of the safety line preferably includes a rigid inner ring member 48 (FIG. 1), the hook portion 44 and the inner ring member 48 being cooperatively configured so that the hook portion 44 is keyed to the inner ring member 48, thereby to enable the looped first end portion 32 of the safety line to be substantially immovably attached to the hook portion and to extend outwardly therefrom in the desired direction.

The second end portion 34 of the safety line 28 passes through a ring 46 on the snap-hook 36 and extends outwardly.

Means are provided on the second end portion 34 of the line which, in cooperation with the ring 46, permit movement of the line through the ring 46 for adjusting the size of the bight 30 as needed. The latter adjustment means may take various forms, but as shown best in FIG. 1 preferably comprises a unitary restraining device 50. The device 50 comprises first and second annular slip collars 52 and 54 at its ends, and an elongated resilient link 56 joining the slip collars. The link 56 is normally rectilinear, but is resiliently flexible to permit the line 28 to be threaded through the slip collars. One of the slip collars is adapted to abut against the ring in response to tension in the line to bias the other slip collar into tighter engagement with the safety line.

An alternative means of adjustment (not illustrated) may comprise a simple device commonly referred to as a "Kellam's Grip", which comprises a tubular slip collar formed of a wire strand whose ends are coiled helically in opposite directions to overlap at several points. Longitudinal elongation and contraction of the tubular slip collar causes it to contract and expand radially, respectively, thereby to tighten and loosen its grip on a line which passes through the slip collar. One end of the slip collar is attachable to the ring 46, and the other end 34 passes through the slip collar, the latter being tightened about the second end of the line in response to tension in the line in the respective direction, while permitting movement of the line therethrough in the opposite direction.

Alternative means of attaching the ends of the safety line 28 to the hand grip member 12 are shown in FIGS. 1, 2, 5 and 6. In FIGS. 1 and 2 a snap-hook 58 is rigidly mounted on the upper surface portion of the hand grip member so as to extend transversely the snap-hook having a hook portion 59 to which the looped end 32A of the safety line is loosely attached and a ring 60 through which the second end portion 34 of the line passes and is adjustably secured by the restraining device 50.

A guide plate 62 is provided on the hand grip member in front of the hook portion 59, to guide the first end portion of the safety line at the required upwardly inclined angle relative to the hand grip member.

In yet another embodiment shown in FIG. 5, the attachment means comprises an attachment ring 64 provided on the upper surface of the hand grip member 10, a first end portion 66 of a safety line 67 being in this case provided with a snap-hook 68 for attachment to the ring, a second end portion 70 passing through the ring 64 and being adapted to be adjustably secured thereto by the restraining device 50. Alternately, two attachment rings 72, 74 may be provided on the hand grip member 10 as shown in FIG. 6, a first end portion 76 of a safety line 77 being hooked onto one ring 72 while the second end portion 78 passes through the other ring 74 and is adjustably secured thereto as hereinbefore desbcribed. In the case where a single ring is provided, a guide plate such as that illustrated in FIG. 1 will be provided in front of the ring 64, and suitably positioned to permit the first end portion 66 of the safety line member to be placed theron, and in the case where two such rings are provided, a guide plate will be suitably positioned in front of the first ring 72 to which the first end portion 76 of the safety line is attached.

The manner of use of the hand grip member 10 is illustrated in FIGS. 7, 8, 10 and 11. Basically, it is necessary to engage the hand grip member 10 with the front of the utility pole 80, normally by placing the blade portion 14 transversely across the front of the pole 80, extending the first and second end portions of the safety line about the pole and attaching them to the hand grip member as hereinbefore described in several examples. The second end portion of the safety line extends outwardly through the respective ring, and may conveniently be gripped when necessary to adjust the bight 30.

The bight 30 should preferably be formed so as to leave sufficient play to permit the hand grip member 10 to be easily moved up or down on the pole when changing its position while climbing, but not so loosely that the hand grip member would fail to grip the pole. Optimally, the bight 30 will be such that it extends upwardly at an angle of between about 5° and 45° from its points of attachment to the hand grip member. This will permit the hand grip member to be self-supportably positioned on the pole without danger of slippage, while permitting it to be manually repositioned at another level. When moving the hand grip member 10 upwards along the pole, the climber will grasp the handle 20, and simply push it upwards. Downward movement of the hand grip member requires that the hand grip member be pivoted upwardly about the blade 14 to lower the angle of the bight 30 nearer to or below the horizontal plane so as to free it from the pole. The hand grip member can then be moved downwards to relocate it. Repositioning is accomplished simply by pivoting the hand grip member downwards, grasping the handle 20 and pulling it downwards for support, thereby causing the bight 30 to tighten about the pole while the toothed portions 26 bite into the pole in response to the downward pivotal movement of the hand grip member 10 about the blade portion 14.

FIG. 7 shows another climbing aid which incorporates a second flexible safety line. In this case the second flexible safety line comprises a safety belt 82 which extends around the pole 80, the belt 82 having its end portions 84, 86 attached to D-rings 88, 90 respectively, on opposite sides of a body belt portion 92 worn about the climber's waist. The second end portion 34 of the first safety line 28 is of such a length that it can be formed into a second bight 94 about the end portions 84, 86 of the attached second safety belt 82. A snap hook 96 is provided on the second end portion 34 of the first safety line 28 end and may be hooked to a suitable attaching means, for example, to the first bight 30 formed thereby, as shown in FIG. 7, thereby closing the second bight, 94. Alternatively, the snap hook 96 may be hooked to the second end portion 34 of the first safety line 28 (as shown by the dotted lines) to enable the bight 94 to be tightened about the ends 84, 86 of the safety belt 82. Should the climber's foothold slip, the second bight 94, held by the hand grip member, restricts downward movement of the belt 82 and coacts with the belt 82 to cause it to tighten about the pole in response to tension in the belt 82.

In the embodiments shown in FIGS. 8 and 9 the second belt 82 further comprises a retractable belt member 98 which is extendable about the pole 80 and above an obstacle to permit the belt 82 to be momentarily detached from the pole, as when, for example, overcoming cross members 99 or other obstacles thereon. In these embodiments, the safety belt 82 comprises a pair of belt segments 100, 102 which are interconnected by means of a buckle 104, each segment being attached to a respective D-ring 88, 90 on the respective side of the body belt portion 92. A housing 103 providing means selectively operable for extending and retracting the retractable belt member 98 is attached to one belt segment 100 and holds one end of the retractable belt member 98. Means for detachably securing the other end of the retractable belt member to the other belt segment 102 comprises a first attaching member 105 provided on the other belt segment 102 and a corresponding second attaching member 106 on the respective end of the belt 98. The housing 103 may be attached directly to the respective D-ring 88, and the first attaching member 105 may be attached directly to the other D-ring 90. However, as illustrated in FIG. 8, housing 103 and the first attachment member 105 are secured to the first and second belt segments 100 and 102, respectively, by means of buckles 107 and 109, thereby permitting the housing 103 and first attachment member to be positioned on the belt as required. The belt segments 100 and 102 are provided with holes which permit the buckles 107 and 109 to be appropriately positioned so that the belt member 98 can be tightened about the front side of the pole 80, while the other safety belt 82 extends about the rear side of the pole 80 so as to encircle the pole for securing the climber thereto in the event that he should lose his grip.

A third attaching member 111 is provided in the body belt portion 92 to which the second attaching member 106 can be attached, in the event that the belt member 98 is extended about the rear side of the pole 80, as a back-up for the safety belt 82. This third attaching member 111 is preferably extendable and retractable by means of a retractable belt portion 115 held in a second retractor housing 113, the latter being attached to the body belt 92. Although not shown in the drawings it will be understood that the first and third attaching members 105 and 111 can be located on the same side of the safety belt 82 as the retractable safety belt 98. In this case, the belt member 98 can be extended to form a bight about one belt segment 102, the second attaching member being subsequently attached, either to the first or third attaching members 105, 111 as needed.

Further embodiments of climbing aids in combination with the above described hand grip member 10 are shown in FIGS. 10 and 11. In FIG. 10 is shown a body belt 92 worn by a climber and having a second flexible safety line 108 attached to opposite D-rings 88, 90 so as to form a bight extending in front of the climbers waist. There are two hand grip members 10 each positioned on the pole 80 in a normal position and at a suitable height. The second end portion of the safety line 28 is provided with a snap hook 96 which is hooked onto the bight 110 formed by the line segment 108, to secure the climber to the pole.

It will be understood that it is equally possible to secure the adjustable end portion of the first safety line to any suitable attaching means, for example, directly to a D-ring provided on the body belt.

The embodiment of FIG. 11 differs from that of FIG. 10 in that there is provided an adjustable line clamp 112 to permit adjustment of the bight 110 formed by the line segment 108 attached to the body belt. The clamp 112 comprises a housing which is attached to one D-ring on the body belt. Means are provided by the line clamp 112 for selectively gripping and releasing the respective end portion of the respective end portion 114 of the line member 108 to permit adjustment of the bight 110 formed by the line.

The latter means comprises a disk-shaped clamp member 118 pivotally mounted in the housing 120, and defines therewith a curved throughpassage 116 for passing the end portion 114 of the line 108 therethrough, to permit it to be adjusted. The line 108 extends about the clamp member, and tension in the line causes the clamp member to pivot against the respective internal wall of the housing to grip the line. Pushing the same end of the line upward into the housing causes the clamp member to pivot in the opposite direction to release the line, and the line can be adjusted by pushing the line through the housing.

FIG. 12 shows another embodiment of a climbing aid according to the invention which incorporates a third flexible safety line having two interconnectible segments 117, 118 being adapted to be extended about pole 80. An end portion 119, 120 of the respective segments 117, 118, is attached to an opposite suspender portion 121, 122, respectively, of a safety harness, shown in detail in FIG. 13. An opposite other end 124, 125 of the segments 117, 118, respectively, is equipped with means for detachably interconnecting the segments 117, 118 about pole 80. Such means typically comprise a female buckle member 126 on the end 124 and a male buckle member 127 on the end 125. The safety harness 123 worn by the climber has, in addition to the suspender portions 121, 122, a body belt portion 92. The suspender portions 121, 122 are each adjustably attached, as by a buckle 131, 132, respectively, at the front of the harness to a front leg strap 129, 130, respectively, which leg strap is preferably attached to the belt portion 92 by, for example, rivets 133.

The suspender portions 121, 122 criss-cross each other at the back of the harness 123, being held in such arrangement by means of a webbing 134, and overlap belt portion 92, to which they are fastened by, for example, rivets 135. The suspender portions 121 and 122 each continue downwardly past the belt portion 92 in the form of a rear leg strap 137, 136, respectively, and each is attached at its lower terminal end, as by stitching, to an adjustable leg belt 138, 139, respectively.

Each frong leg strap 129 and 130 is similarly attached at its lower terminal end to the respective leg belt 139 or 138. The manner of wearing of the harness by the climber is readily apparent from FIG. 12.

Means for detachably securing the other ends 124, 125 of both of the third line segments 117, 118, are separately provided on the same suspender portion to which the respective third line segment is attached. That is, a male buckle member 140 is provided on the suspender portion 121 whereby the third line segment 117 is able to loop around so as to allow the female buckle member 126 to engage the male buckle member 140, as shown in phantom lines in FIG. 12, so as to detachably secure the end 124. In this manner, the third line segment 117 may be used by itself to secure the climber for overhead suspension to, for example, a pole cross member 128. This is especially important where the safety belt 82 is disconnected from around pole 80, as, for example, where the climber wishes to overcome a cross member 99 or other obstacle on pole 80.

In an analagous manner to the suspender portion 121, the suspender portion 122 is provided with a female buckle member 141 to engage the male buckle member 127, and hence detachably secure the end 125 of the third line segment 118.

It is preferable to separately provide both of the third line segments 117, 118 with selectively operable means for extending and retracting the segments as needed. Accordingly, a retractor housing 103 containing known extension and retraction means is affixed, as by riveting (not shown) to the respective suspender portion 121 or 122. The third line segment 117 or 118 extends from or retracts into its respective retractor housing 103 when not required by the climber.

The safety device of FIG. 12 is in all other material respects similar to the safety device of FIG. 8 in its construction and in the manner of its operation, except that the retractable belt members 98 and 115 (of FIG. 8) and their associated attachment means are omitted.

I claim:

1. A hand held pole climbing aid comprising a hand grip member having a blade portion at one end disposed to extend transversely across a pole to be climbed, a handle portion at the other end adapted to be grasped to pivot the hand grip member downwardly about said blade portion, a pair of toothed portions extending downwardly at the ends of said blade portion and adapted to engage the pole upon pivotal movement of the hand grip member, a safety line of relatively stiff but flexible material adapted to form a bight to extend loosely about the pole for holding said hand grip member to the pole, means for removably attaching first and second end portions of said line to the hand grip member to permit the line to form a bight extending therefrom at a predetermined angle which is inclined in an upward direction, said attaching means including adjustable gripping means engageable with the second end portion of the line member to permit movement of said second end portion with respect to the hand grip member for adjusting the size of the bight, said adjustable gripping means being responsive to tension in the safety line for restraining said second end portion.

2. A hand held pole climbing aid as claimed in claim 1, in which the means for removably attaching said first and second end portions of the safety line comprises an attaching ring provided on an upper surface portion of the hand grip member, said first end portion of the safety line being provided with a snap-hook adapted to be hooked to said attaching ring, said second end portion of the safety line being adapted to be adjustably secured thereto by said adjustable gripping means.

3. A hand-held pole climbing aid as claimed in claim 1, in which the means for removably attaching said first and second end portions of the safety line comprises a pair of attaching rings provided on an upper surface portion of the hand grip member, said first end portion of the safety line being provided with a snap-hook adapted to be hooked to one of said rings, and the second end portion of said safety line being adapted to be adjustably secured thereto by said adjustable gripping means.

4. A hand-held pole climbing aid as claimed in claim 1, in which the means for removably attaching the first and second end portions of the safety line comprises a snap-hook rigidly secured to an upper surface portion of the hand grip member, the snap-hook having a hook portion for removably attaching the first end portion of the safety line thereto, and a ring through which the second end portion of the safety line extends.

5. A hand-held pole climbing aid as claimed in claim 4, in which the hook portion of the snap hook is positioned to extend from said upper surface portion at said predetermined angle, said first portion of the safety line having a loop for attachment to the hook portion, the hook portion being keyed into the loop to supprot said first end portion at the required angle.

6. A hand-held pole climbing aid as claimed in claim 2, wherein the adjustable gripping means comprises first and second slip collars through which the second end portion of the safety line extends, and a resilient link interconnecting the slip collars so as to bias the slip collars normally to grip the line, said second end portion extending through said attaching ring, said annular slip collars engaging on the safety line on opposite sides of the attaching ring, one of the slip collars being adapted to abut against the ring in response to tension in the line to bias the other slip collar into tighter engagement with the safety line.

7. A hand-held pole climbing aid as claimed in claim 4 or 5, wherein the adjustable gripping means comprises first and second annular slip collars through which the second end portion of the safety line, a resilient link interconnecting the annular slip collars so as to bias the slip collars normally to grip the line, said second end portion extending through said ring of the snap hook, the annular slip collars engaging the safety line on opposite sides of the ring, one of the slip collars being adapted to abut against the ring in response to tension in the line to bias the other slip collar into tighter engagement with the safety line.

8. A hand-held pole climbing aid as claimed in claim 1, in which the elongated safety line comprises an inner portion of braided fibrous material and an outer portion coating formed on the inner portion.

9. A hand-held pole climbing aid as claimed in claim 1, in which the hand grip member comprises a flat rigid body with downturned sides the latter being configured to form the pair of toothed portions, the handle and the blade portions being formed integrally with the flat, rigid body.

10. A hand-held pole climbing aid as claimed in claim 9, in which the blade portion is formed with an inwardly contoured edge to approximate the curvature of the pole to be climbed.

11. A hand-held pole climbing aid as claimed in claim 10, in which the blade has a shallow V-shaped contour.

12. A climbing aid as claimed in claim 1, further comprising a second flexible safety line adapted to be extended about the pole and having end portions attachable to opposite sides of a body belt portion worn about the climber's waist, the second end portion of the first safety line being adapted to form a bight around the end portions of the second safety line, the second end portion of the first safety line being attachable to said second safety line for closing said bight.

13. A climbing aid as claimed in claim 12, in which the second safety line comprises a pair of belt segments having means for detachably interconnecting them about the pole and further comprising a retractable safety line adapted to extend about the pole, means provided on one said line segment selectively operable for extending and retracting said retractable safety line and means for detachably securing the retractable safety line to the other line segment.

14. A climbing aid comprising in combination, a flexible safety belt adapted to be extended about a pole to be climbed, comprising a pair of belt segments one end of each being attachable to a respective side of a body belt worn about the climber's waist, the other ends being provided with means for detachably interconnecting them about the pole, a retractable safety belt adapted to extend about the pole, means provided on one said belt segment selectively operable for extending and retracting one end of the retractable safety belt and means for detachably securing the other end of the retractable safety belt to the other belt segment.

15. A climbing aid comprising in combination;

a hand held pole climbing aid comprising a hand grip member having a blade portion at one end disposed to extend transversely across a pole to be climbed, a handle portion at the other end adapted to be grasped to pivot the hand grip member downwardly about said blade portion, a pair of toothed portions extending downwardly at the ends of said blade portion and adapted to engage the pole upon pivotal movement of the hand grip member, a first safety line of relatively stiff but flexible material adapted to form a bight to extend loosely about the pole for holding said hand grip member to the pole, means for removably attaching first and second end portions of said safety line to the hand grip member to permit the line member to form a bight extending therefrom at a predetermined angle which is inclined in a upward direction, said attaching means including adjustable gripping means engageable with the second end portion of the safety line to permit movement of said second end portion with respect to the hand grip member for adjusting the size of the bight, said adjustable gripping means being responsive to tension in the safety line for restraining said second end portion, and a second flexible safety line adapted to be attached to a body belt worn about the climber's waist so as to form a bight extending in front of the climber's waist, said second end of the first mentioned safety line member having a snap-hook adapted to be hooked onto said bight.

16. A climbing aid as claimed in claim 15, wherein the second means of attachment of the second flexible safety line comprises an adjustable line clamp attached to the safety belt, the line clamp providing means for selectively gripping and releasing the respective end portion of the second safety line to permit adjustment of the bight formed by said line.

17. A climbing aid as claimed in claim 16 in which the adjustable line clamp comprises a housing which is attached to one side of said safety belt, means in the housing forming a throughpassage for passing the respective end portion of the second safety line member therethrough and means operable for clamping said respective end portion of the second safety line to prevent movement thereof through the housing.

18. A climbing aid as claimed in claim 1, further comprising a second flexible line adapted to be extended about the pole and having end portions attachable to opposite sides of a body belt portion of a safety harness, having at least two suspender portions, which harness is worn by the climber, the second end portion of the first safety line being adapted to form a bight around the end portions of the second safety line, the second end portion of the first safety line being attachable to said second safety line for closing said bight.

19. A climbing aid as claimed in claim 18, in which the second safety line comprises a pair of belt segments, having means for detachably interconnecting said segments about the pole.

20. A climbing aid as claimed in claim 19, further comprising a third flexible safety line having two interconnectible segments, said third line being adapted to be extended about the pole and having end portions of each segment attached to opposite suspender portions of the safety harness, the other ends of each segment being provided with means for detachably interconnecting said segments about the pole.

21. A climbing aid according to claim 20 wherein means for detachably securing the other end of at least one third line segment is provided on the same suspender portion to which said third line segment is attached.

22. A climbing aid according to claim 21 wherein at least one of the third line segments is provided with selectively operable means for extending and retracting said segments.

23. A climbing aid according to claim 22 wherein both third line segments are separately provided with selectively operable means for extending and retracting said segments.

* * * * *